US006751905B1

(12) United States Patent
Daumal Castellon

(10) Patent No.: US 6,751,905 B1
(45) Date of Patent: Jun. 22, 2004

(54) WINDOW LIFTING DEVICE FOR MOTOR VEHICLES

(76) Inventor: Melchor Daumal Castellon, Diputación, 455-457, 08013, Barcelona (ES)

( * ) Notice: Subject to any disclaimer, the term of this patent is extended or adjusted under 35 U.S.C. 154(b) by 139 days.

(21) Appl. No.: 09/856,520

(22) PCT Filed: Nov. 2, 2000

(86) PCT No.: PCT/ES00/00419

§ 371 (c)(1),
(2), (4) Date: Oct. 2, 2002

(87) PCT Pub. No.: WO01/33020

PCT Pub. Date: May 10, 2001

(30) Foreign Application Priority Data

Nov. 5, 1999 (ES) ..... 9902426

(51) Int. Cl.[7] ..... E05F 11/48; E05F 15/08
(52) U.S. Cl. ..... 49/352; 49/349
(58) Field of Search ..... 49/352, 349, 350, 49/351, 374, 375, 502, 348, 227

(56) References Cited

U.S. PATENT DOCUMENTS 4,691,475 A 9/1987 Maekawa ..... 49/352
5,477,641 A * 12/1995 Heckel et al. ..... 49/352 X
5,564,230 A * 10/1996 Periou ..... 49/352 X
5,740,630 A * 4/1998 Medebach ..... 49/352
5,782,038 A 7/1998 Sponable et al. ..... 49/352
5,809,695 A 9/1998 Strickland ..... 49/352

FOREIGN PATENT DOCUMENTS

| | | |
|---|---|---|
| ES | 8307329 | 10/1983 |
| ES | 2035714 | 4/1993 |
| WO | 99/33680 | 7/1999 |

* cited by examiner

*Primary Examiner*—Hugh B. Thompson, II
(74) *Attorney, Agent, or Firm*—Ostrolenk, Faber, Gerb & Soffen, LLP

(57) ABSTRACT

A raising device for displacing car windows includes a guide provided with rollers and a glider slidable by the guide and powered with a cable because of a motor. At least the guide, the rollers and the cable are symmetrical with regard to an axis provided perpendicularly at the middle point of the guide, in such a way that these elements may be a portion of raising devices for car windows on both sides of the car. The guide further incorporates, at its opposite ends, end-of-run catches for the glider, which serves also as lodging for the sheath's terminal through the inside of which runs the cable.

6 Claims, 2 Drawing Sheets

WINDOW LIFTING DEVICE FOR MOTOR VEHICLES

DESCRIPTION

The present invention concerns a "RAISING DEVICE FOR CAR WINDOWS", with novel characteristics of construction, shaping and design that fullfill the task for which it has been specifically designed, with a maximum safety and efficiency.

Driving a car's windows is done commonly by mounting devices placed at the car doors which are driven by an electric motor which operates mechanical elements, such as guides and cables, that operate the window of the car door. That operation causes raising or lowering of the window in an automatic way when the user pushes a switch commonly placed at the interior panel of the door or at the car instrument panel.

Conventional devices have the drawback that their structural configuration is only valid for the door of one of the sides of the car where the device is to be installed. Therefore, manufacturing of raising devices for windows means the duplicated production of the several elements included, the ones for the doors of one side and the others for the doors of the other side of the vehicle.

The need to manufacture different elements for adapting the raising device to the geometric needs inherent to the configuration of a vehicle door have a negative influence an the costs of installation and, therefore, on the total costs of the car.

SUMMARY OF THE INVENTION

The main object of the present invention is to provide a window raising device for cars having basically structural symmetry in order that the components are the same for the doors of both sides of the car and substantially reducing the manufacturing costs.

A raising device for car windows according to the present invention achieves this object and provides several further advantages which will be apparent in this description.

Generally speaking, the device oft he present invention is oft he type including a single guide provided at both ends with rollers and a glider element capable of running along the guide by means of a cable which is actuated by a motor so that it runs along the guide with the help of the rollers.

The main feature of the device of the invention is that at least the guide, the rollers and the cable are symmetrical, so that the elements may be a part of the raising devices for windows at both sides of the car.

For that, the symmetry must be established with regard to an axis perpendicular to the guide at its midpoint. This provides an important reduction both of the manufacturing costs (tooling reduction) and of the parts classification, since it does not matter to which side of the car it belongs.

Advantageously, the raising device for car windows of the present invention has the special feature that the guide incorporates, both at its opposite ends, end-of-run catches formed at the same guide, which serve further as the housing of the terminal of the sheath by the inside of which the cable circulates.

The advantages and characteristics of the device of the present invention will be clear because of the following detailed description of a preferred embodiment as a non limitative example with reference to the accompanying drawings.

DESCRIPTION OF A PREFERRED EMBODIMENT

The elements shown include: (1) guide or rail, (2) end of the guide, (3) end of the guide, (4) roller, (5) roller, (6) lateral crevice, (7) lateral crevice, (8) projection, (9) projection, (10) gliding element, (11) cable, **(11*a*) upper portion of the cable, (11*b*) lower portion of the cable, (12) glider body, (13) glider body, (14) gliding zone, (15) gliding zone, (16) contact points, (17) motor, (18) motor cover, (19) symmetrical axis, (20) anchoring points to the door, (21) anchoring points to the door, (22) tongues of the glider body, (23) fixation elements, (24) branch of fixation element, (25) branch of fixation element, (26) projection, and (27)** projection.

Figure 1:
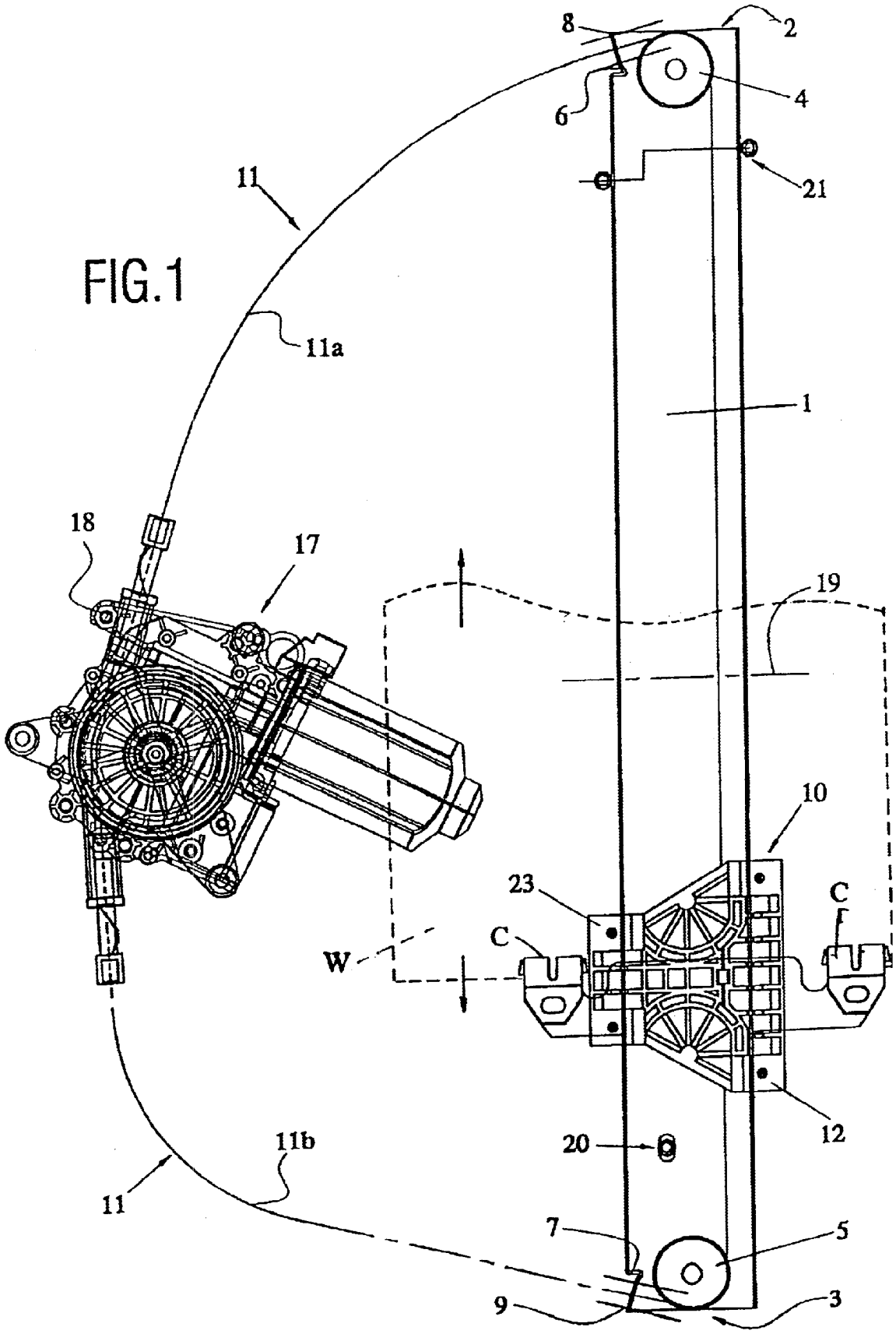
FIG. 1 is a front elevation view of a raising device for car windows according to the present invention.

With particular reference to FIG. 1 of the attached drawings, a device according with the present invention is formed with a guide (1) having a great width for increasing the resistance. The guide (1) is provided at both ends (2, 3) with respective rollers (4, 5). At the ends (2, 3) oft he guides there are lateral crevices (6, 7) defining corresponding projections (8, 9). The crevices (6, 7) work as end-of-course checks for a gliding element (10). The combination of the crevices (6, 7) and projections (8, 9) at the ends (2, 3) of the guide (1) also provide housings for the terminals of the sheath through the interior of which runs the operation cable (11). The crevices (6, 7), the projections (8, 9) and the housing for the guide (1) are shaped in the same embossing operation in the manufacturing process.

The gliding element (10) is formed by two bodies (12, 13) and the assembly defined by both bodies (12, 13) is displaceable along the guide (1) according to movement of the cable (11), which runs along the guide (1) with the help of the rollers (4, 5), above. The gliding element has clamps "C" supporting a car window W as diagrammatically shown in FIG. 1.

Figure 2:
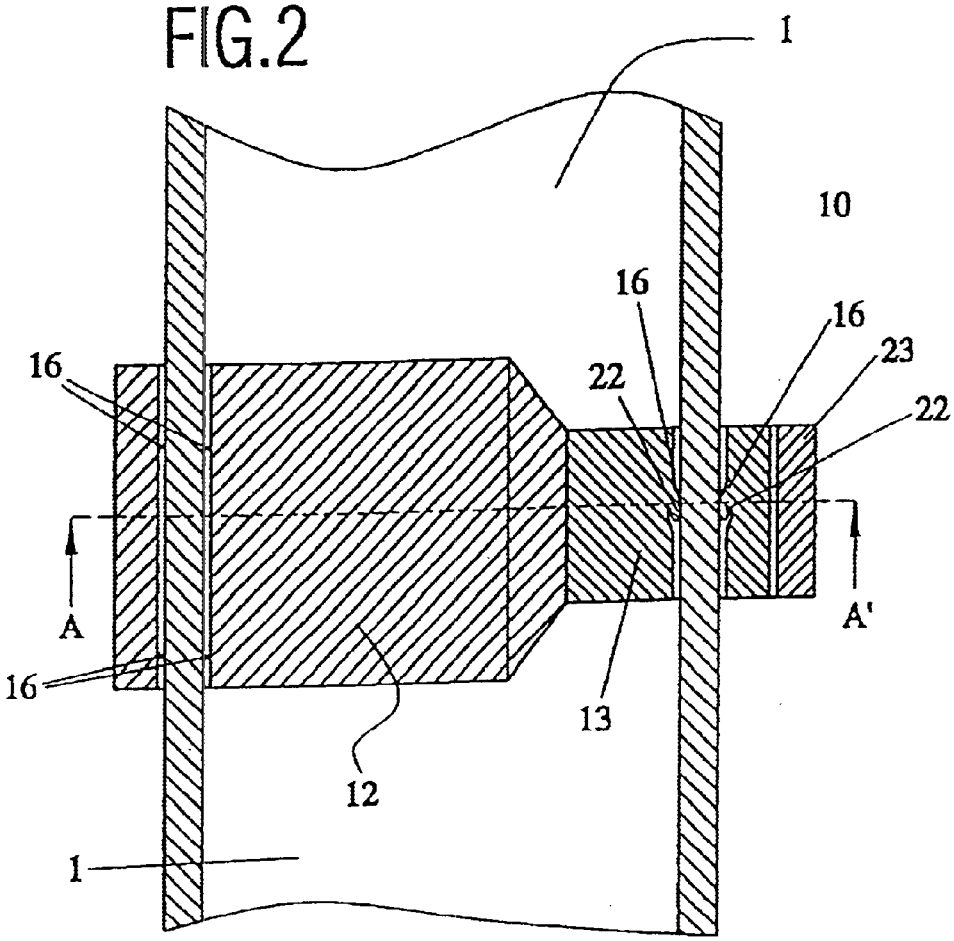
FIG. 2 is a sectional view cut off at plane B–B' of FIG. 3.
Figure 3:
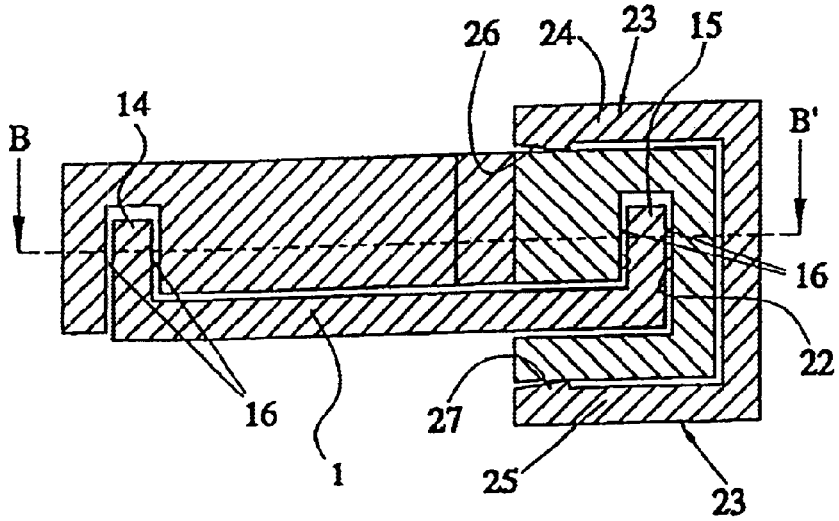
FIG. 3 is a cross sectional view as per the plan A–A' of FIG. 2.

According to FIGS. 2 and 3, the guide (1) has a cross-section in the shape of a "U". The gliding element (10) features a complementary shape for fitting in the zones (14, 15) of the guide (1), as shown in FIG. 3.

According to FIGS. 2 and 3, guidance of the gliding of the element (10) with respect to the guide (1) is performed by the zones (14, 15) of the guide (1), existing four contact zones which correspond to four contact points (16) at each side of the these zones (14, 15) of the guide (1). This brings great stability in the advancement of the gliding element (10) by the guide (1).

The cable is operated by an electric motor (17) provided with a cover (18).

In the Figures, the guide (1) with the rollers (4, 5) as well as the cable and its sheath and the cover (18) of the motor (17) are symmetrical with respect to an axis of symmetry (19) illustrated in FIG. 1. In this sense, the length of the sheath of the cable at the upper portion **(11*a*) and the lower portion (11*b*)** are the same.

In this way, the raising device for car windows is the same for the left hand door and for the right hand door of the car. It is clear that certain elements such as the anchoring points (20, 21) to the respective doors may be different according to the geometry itself of the door of reference. Thus, there is obtained a reduction in the costs of manufacturing and classification of the parts forming the device of the invention, since it does not matter to which side belong the same.

Referring to the FIGS. 2 and 3, the body (13) of the gliding element (10) is provided with resilient tongues (22) which permit reducing the tolerance values of the body (13) in order to offer a more precise gliding of the element.

The gliding element (10) is provided, in the assembly position, with a fixation element (23) in the shape of an inverted "C" whose branches (24, 25) pressure embrace the gliding element (10) against the guide (1) with the cooperation of certain projections (26, 27) insuring the position of the whole.

The invention is not considered limited to the preferred incorporation described above, being possible to incorporate the changes and detail modifications deemed convenient, provided that the essence of the invention is not altered nor departing from the inventive scope which is resumed in the following claims.

What is claimed is:

1. A raising device for car windows comprising:

an elongated guide extending along a longitudinal axis and having opposite ends, the elongated guide being arranged symmetrically with respect to a symmetry axis spaced equidistantly between the opposite ends of the elongated guide;

a respective roller mounted rotatably at each of the opposite ends;

a gliding element mounted slidably on the elongated guide for supporting a car window;

a motor operatively connected to the gliding element; and at least one cable, a first portion of the cable extending from one of the rollers to the motor and a second portion of the cable extending from another one of the rollers to the motor, the cable being guided by the rollers and coupled to the motor and to the gliding element such that when the motor operates in a first condition, the gliding element is displaceable to a first position in which the car window is open, and when the motor operates in a second condition, the gliding element is displaceable to a second position in which the car window is closed, wherein the motor is adapted to be fixed at a location relative to the elongated guide, such that lengths of the first and second portions of the cable are substantially the same on either side of the symmetry axis.

2. The raising device defined in claim 1, wherein the motor has a cover arranged symmetrically with respect to the axis of symmetry.

3. A raising device for car windows comprising:

an elongated guide extending along a longitudinal axis and having opposite ends:

a respective roller mounted rotatably at each of the opposite ends;

a gliding element mounted slidably on the elongated guide for supporting a car window;

a motor operatively connected to the gliding element; and at least one cable guided by the rollers and coupled to the motor and to the gliding element such that when the motor operates in a first condition, the gliding element is displaceable to a first position in which the car window is open, and when the motor operates in a second condition, the gliding element is displaceable to a second position in which the car window is closed, the elongated guide and the at least one cable are arranged symmetrically with respect to a symmetry axis spaced equidistantly between the opposite ends and extending perpendicular to the longitudinal axis, wherein the elongated guide has a respective crevice spaced uniformly from the axis of symmetry in opposite directions along the longitudinal axis, and provided on a respective one of the opposite ends of the elongated guide and each crevice is shaped for preventing further displacement of the gliding element along the guide after the gliding elements has engaged a respective crevice, the at least one cable having an outer sheath provided with opposite ends each of which is received in a respective crevice.

4. A device to raise a car window of a car on either side of the car, the device comprising:

an elongated guide extending along a longitudinal axis and having opposite ends, the elongated guide being arranged symmetrically with respect to a symmetry axis spaced equidistantly between the opposite ends of the elongated guide;

a respective roller mounted rotatably at each of the opposite ends;

a gliding element mounted slidably on the elongated guide for supporting a car window;

a motor operatively connected to the gliding element; and at least one cable, a first portion of the cable extending from one of the rollers to the motor and a second portion of the cable extending from another one of the rollers to the motor, the cable being guided by the rollers and coupled to the motor and to the gliding element such that when the motor operates in a first condition, the gliding element is displaceable to a first position in which the car window is open, and when the motor operates in a second condition, the gliding element is displaceable to a second position in which the car window is closed, wherein the motor is adapted to be fixed at a location relative to the elongated guide, such that lengths of the first and second portions of the cable are substantially the same on either side of the symmetry axis, thereby permitting the device to be used in a door on either side of the car.

5. The raising device defined in claim 4, wherein the motor has a cover arranged symmetrically with respect to the axis of symmetry.

6. A device to raise a car window of a car on either side of the car, the device comprising:

an elongated guide extending along a longitudinal axis and having opposite ends;

a respective roller mounted rotatably at each of the opposite ends;

a gliding element mounted slidably on the elongated guide for supporting a car window;

a motor operatively connected to the gliding element, and at least one cable guided by the rollers and coupled to the motor and to the gliding element such that when the motor operates in a first condition, the gliding element is displaceable to a first position in which the car window is open, and when the motor operates in a second condition, the gliding element is displaceable to a second position in which the car window is closed, the elongated guide and the at least one cable being configured in a manner that permits the device to be used in a door on either side of the car, wherein the elongated guide has a respective crevice spaced uniformly from the axis of symmetry in opposite directions along the longitudinal axis, and provided on a respective one of the opposite ends of the elongated guide and each crevice is shaped for preventing further displacement of the gliding element along the guide after the gliding elements has engaged a respective crevice, the at least one cable having an outer sheath provided with opposite ends each of which is received in a respective crevice.

* * * * *